US008375644B2

(12) United States Patent
Robins

(10) Patent No.: US 8,375,644 B2
(45) Date of Patent: Feb. 19, 2013

(54) GUTTER GUARD

(75) Inventor: Evelyn M. Robins, Ruckersville, VA (US)

(73) Assignee: Leafsolution, LLC, Rochelle, VA (US)

( * ) Notice: Subject to any disclaimer, the term of this patent is extended or adjusted under 35 U.S.C. 154(b) by 0 days.

(21) Appl. No.: 13/137,361

(22) Filed: Aug. 8, 2011

(65) Prior Publication Data

US 2012/0110923 A1 May 10, 2012

Related U.S. Application Data

(60) Provisional application No. 61/371,807, filed on Aug. 9, 2010.

(51) Int. Cl.
*E04D 13/064* (2006.01)

(52) U.S. Cl. ..... 52/12

(58) Field of Classification Search ..... 52/11, 12; 210/162, 474

See application file for complete search history.

(56) References Cited

U.S. PATENT DOCUMENTS

| | | | | |
|---|---|---|---|---|
| 310,359 | A | 1/1885 | Baggs | |
| 417,264 | A | 12/1889 | Miller | |
| 466,596 | A | 1/1892 | Blair | |
| 2,423,923 | A * | 7/1947 | Audino | 210/474 |
| 3,295,264 | A | 1/1967 | Olson | |
| 4,936,061 | A | 6/1990 | Palma | |
| 4,941,299 | A | 7/1990 | Sweers | |
| 4,959,932 | A * | 10/1990 | Pfeifer | 52/12 |
| 5,010,696 | A | 4/1991 | Knittel | |
| 5,072,551 | A | 12/1991 | Manoogian, Jr. | |
| 5,109,640 | A | 5/1992 | Creson | |
| 5,406,754 | A * | 4/1995 | Cosby | 52/12 |
| 5,438,803 | A | 8/1995 | Blizard, Jr. | |
| 5,592,783 | A | 1/1997 | Jones | |
| 5,729,931 | A | 3/1998 | Wade | |
| 5,956,904 | A * | 9/1999 | Gentry | 52/12 |
| 6,134,843 | A * | 10/2000 | Tregear | 52/12 |
| 6,298,612 | B1 | 10/2001 | Adams | |
| 6,598,352 | B2 * | 7/2003 | Higginbotham | 52/12 |
| 6,951,077 | B1 | 10/2005 | Higginbotham | |
| 2001/0037610 | A1 | 11/2001 | Davis | |
| 2004/0006927 | A1 | 1/2004 | Wickett | |
| 2006/0179723 | A1 * | 8/2006 | Robins | 52/11 |
| 2008/0127575 | A1 * | 6/2008 | Ealer | 52/12 |
| 2010/0088971 | A1 * | 4/2010 | Horton | 52/12 |

FOREIGN PATENT DOCUMENTS

| | | |
|---|---|---|
| DE | 3838919 | 5/1989 |
| JP | 54-153324 | 12/1979 |

* cited by examiner

*Primary Examiner* — Christine T Cajilig
(74) *Attorney, Agent, or Firm* — Nixon & Vanderhye PC

(57) ABSTRACT

A gutter guard constructed to be mounted on a gutter and to extend from the front to the rear thereof. The gutter guard comprises a central screen portion, a front mounting portion and a rear mounting portion. The central screen portion comprises a fine mesh top layer and a bottom support layer of expanded construction with openings of a desired size. The front mounting portion comprises a first metal sheet folded over and crimped to an adjacent front end of the screen portion. The rear mounting portion comprises a second metal sheet folded over and crimped to an adjacent rear end of the screen portion. The mesh top layer is hemmed to the bottom support layer and they are thereafter roll formed in a new and improved manner to prevent damage to the mesh top layer, to control its tension, and to provide close contact of the mesh top layer to the bottom support layer.

9 Claims, 3 Drawing Sheets

GUTTER GUARD

CROSS REFERENCE TO RELATED APPLICATION

This application claims the priority of Provisional Patent Application No. 61/371,807 filed on Aug. 9, 2010.

BACKGROUND OF THE INVENTION

1. Field of the Invention

The present invention relates to gutter covers, and more particularly to a gutter guard or screen that enhances the flow of water into a gutter and prevents debris from collecting in the gutter and subsequently blocking the flow of water through the gutter.

2. Description of the Related Art

Gutters are open-top channels that collect and direct water away from a building and its foundation. The opening to the gutter channel must remain unobstructed in order for the gutter to function properly. It is common for debris, such as leaves, cones, seeds, pine needles and the like, to collect and block water flow. Obstruction of the gutter channel causes the gutter to overflow and become ineffective. Many people clean their gutters regularly as part of a preventive maintenance program, while others resort to such devices as covers and guards in an attempt to shield the gutter from the accumulation of debris in the channel.

Many of these guards use a single wire layer to cover the open top of the gutter. Other guards combine a wire layer with a mesh layer to keep debris out. The guard helps prevent large debris, such as cones or seeds, from settling in the gutters. However, smaller particles often slip past such layers. The structure of the guards is generally flat so that the layers lay flat above the opening. Sometimes the integrity of the guard cannot be maintained against heavy debris or debris that has collected and settled on the guard over time.

Consequently, there is a need for a device that covers the open top of a gutter channel and that prevents both large and small debris from entering and collecting in the gutter with resultant obstruction of the gutter, but freely permits the passage of rain water into the gutter to prevent surface water from collecting on the roof. It is further desirable that such a device enhance the flow of rain water into the gutter, be simple in construction, easy to manufacture and easy to install. The new and improved gutter guard of the present invention is not subject to the above-described disadvantages and meets the needs described herein.

BRIEF SUMMARY OF THE INVENTION

The new and improved gutter guard of the present invention comprises elongated panels of any suitable length, such as 96 inches, which may be mounted end to end on a gutter and may be formed of any suitable material. The gutter guard generally comprises a central screen portion, a front mounting portion constructed to be mounted on a front of a gutter and a rear mounting portion constructed to engage and be secured to the fascia or other adjacent portion of a building on which the gutter is mounted.

The central screen portion comprises a fine mesh top layer formed of a suitable material, such as stainless steel, and a bottom support layer of expanded material such as aluminum having openings through which rain water may fall into the gutter. The mesh top layer is hemmed around the front and rear ends of the expanded support layer and they are thereafter roll-formed to form the central screen portion which has a raised plateau area in the mid portion thereof for the purpose of slowing the flow of rain water from the rear portion toward the front portion thereof and creating a large flat dissipation area through which rain water will flow through the mesh and support layer into the gutter.

The front mounting portion comprises a first metal sheet that is crimped over the front end of the central screen portion and comprises a depending lip which may be curved to extend outwardly. The front mounting portion is constructed to rest on the front of the gutter and to be secured thereto in any suitable manner, such as by screws.

The first metal sheet of the front mounting portion has an embossed outer surface and is formed on the underside of the crimped portion thereof with a plurality of crimped areas in an overlapping pattern. The embossed surface serves as a water decelerator and also helps to shed debris which may accumulate thereon. The overlapped crimped areas serve to deflect the flow of water which may wick around the depending lip away from the front of the gutter guard.

The rear mounting portion comprises a second metal sheet that is crimped at its front end over the rear end of the central screen portion and extends rearwardly in a generally flat portion that terminates in an upstanding leg that extends rearwardly at an angle to the flat portion for flexible engagement with the adjacent rear portion of the gutter or fascia or other portion of a building on which the gutter is mounted. The second metal sheet of the rear mounting portion is formed with an embossed outer surface for the purpose of serving as a water decelerator and also helping to shed debris which may accumulate thereon. The angled rear leg of the metal sheet is constructed to frictionally engage the rear gutter portion, fascia or other adjacent portion of the building in a spring-loaded manner to ensure adequate contact therewith when the guard is mounted on a gutter. The leg may be secured to the gutter, fascia or other adjacent portion of the building in any suitable manner, such as by screws or the like. The securing of the leg to the fascia combined with the securing of the front mounting portion to the front of the gutter creates a box like girder strength for the complete gutter system and additional hanging strength to augment the gutter bracket sturdiness.

DETAILED DESCRIPTION OF THE PREFERRED EMBODIMENTS

Figure 1:
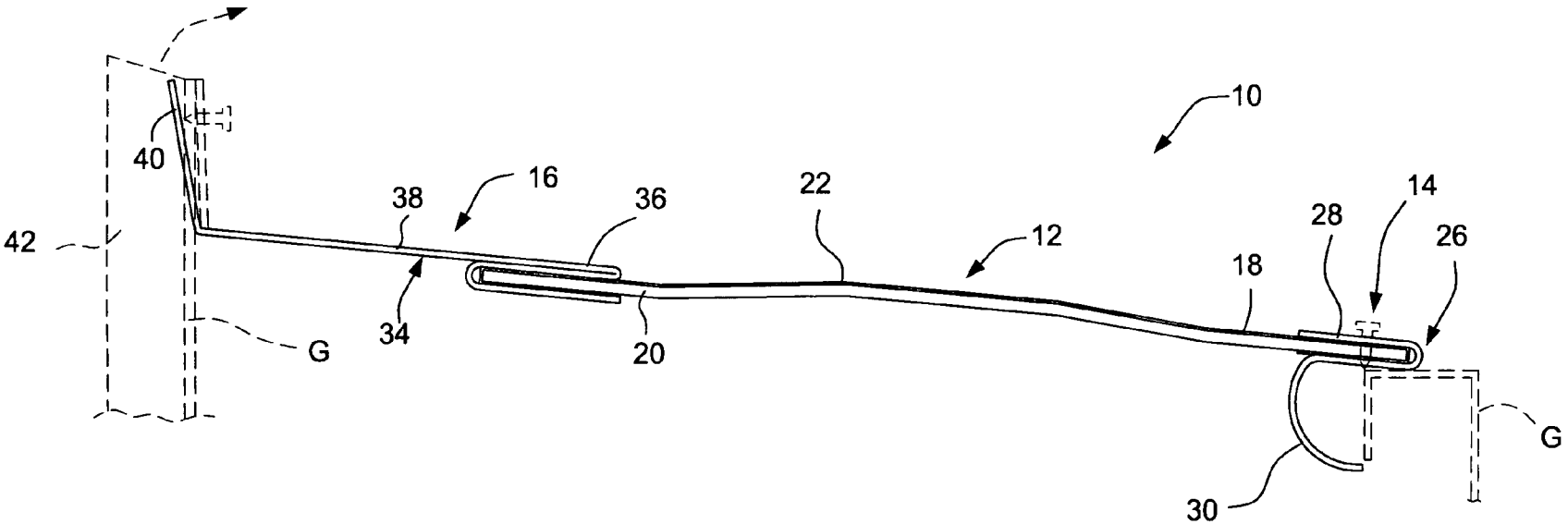
FIG. 1 is a side elevational view of a gutter guard formed in accordance with the present invention, showing the adjacent portions of a gutter and building in broken lines.
Figure 3:
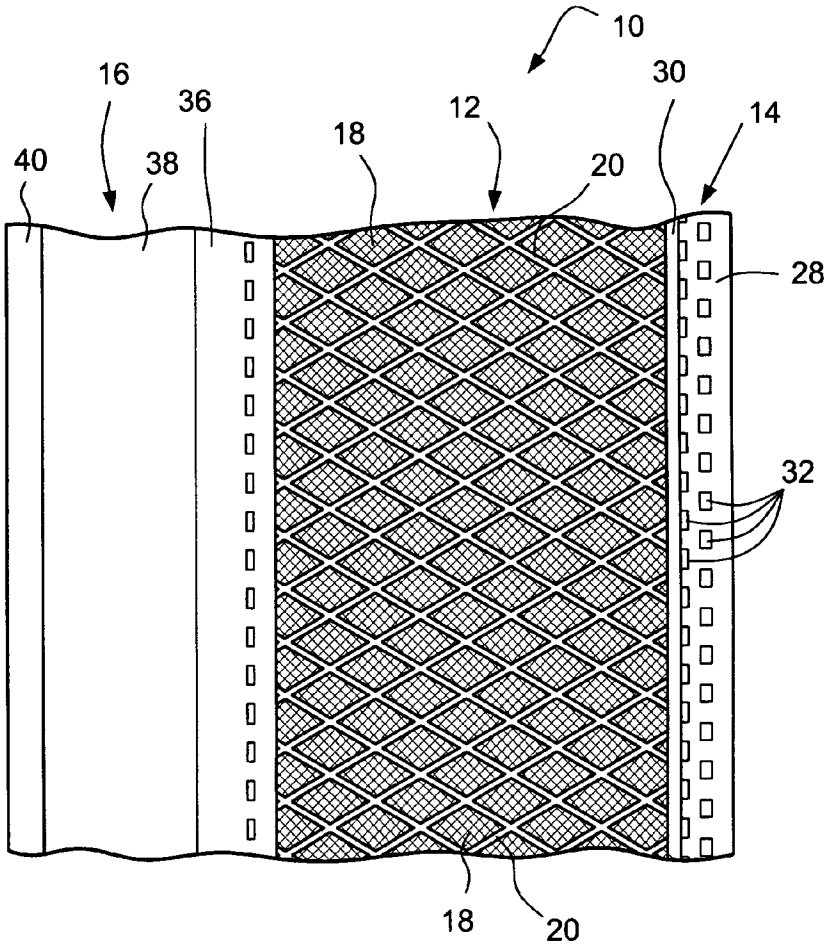
FIG. 3 is a bottom plan view of a portion of the gutter guard shown in FIG. 1.
Figure 2:
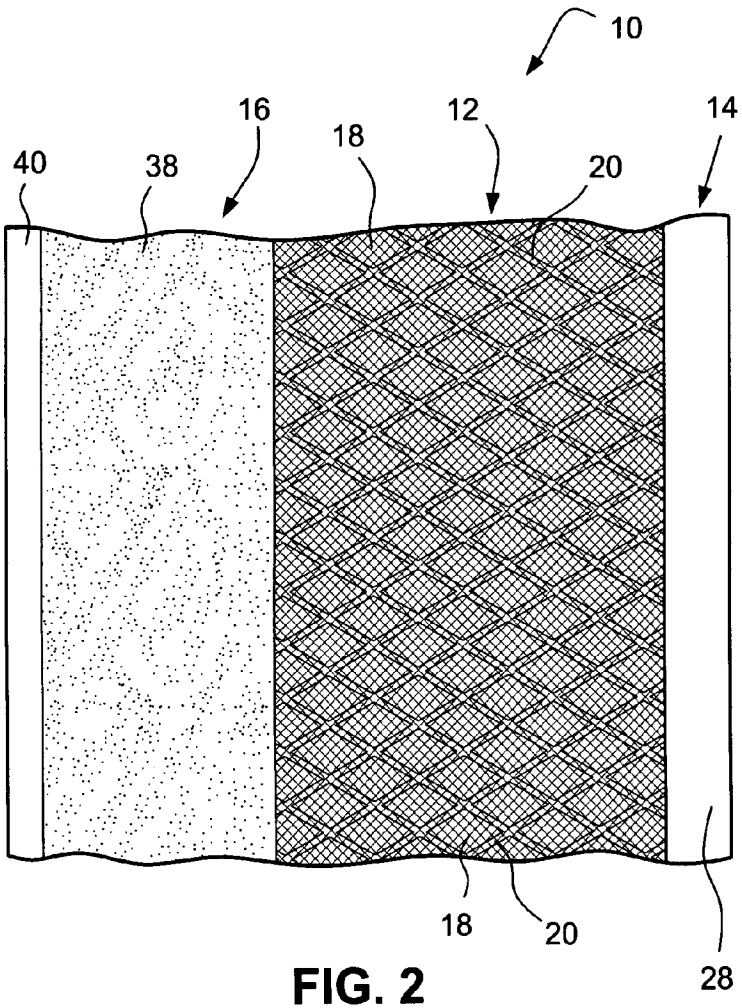
FIG. 2 is a top plan view of a portion of the gutter guard shown in FIG. 1.

Referring to FIGS. 1-3, the gutter guard 10 of the present invention generally comprises a central screen portion 12, a front mounting portion 14 and a rear mounting portion 16 which are secured together and formed of suitable materials as described hereinafter.

The central screen portion 12 comprises a fine mesh top layer 18 formed of a suitable material such as stainless steel and having a suitable mesh screen size.

The central screen portion 12 also comprises a bottom support layer 20 of expanded construction which may be formed of any suitable material, such as expanded aluminum having any suitable pattern and openings of any suitable size to enable rain water to flow through the mesh top layer and through the support layer into an underlying gutter. As an illustrative example, the support layer 20 may be formed of an expanded metal having a thickness of approximately 0.62 inches and the openings therein may be approximately 0.5 inches in maximum length and 0.25 inches in maximum width.

As shown in FIG. 1, the mesh top layer 18 and bottom support layer 20 are roll-formed to provide a raised "plateau" area 22 in the middle of the central screen portion 12 which serves to slow the flow of rain water from the rear to the front thereof and provides a large raised area to facilitate the flow of the slowed rain water through the mesh top layer 18 and bottom support layer 20 of the central screen portion 12 into the underlying gutter. As an illustrative example, the raised "plateau" area 22 may be approximately 0.125 inches to 0.25 inches in height and approximately 1 inch or more in length.

Figure 4A:
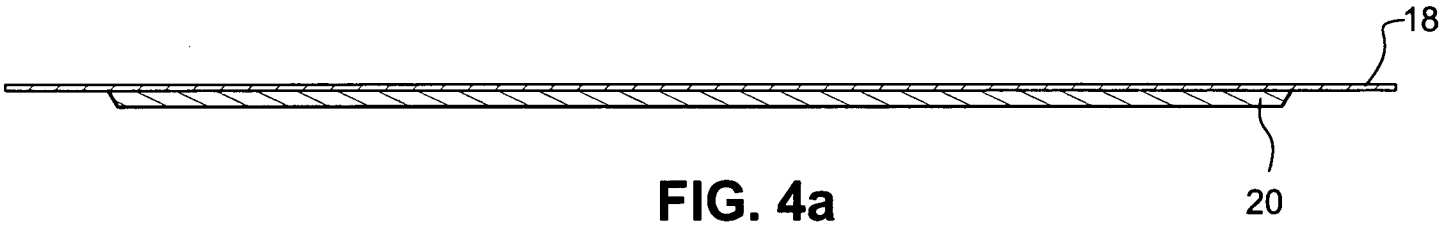
FIGS. 4*a*, 4*b* and 4*c* are side elevational views showing the steps in the mounting of the mesh top layer on the expanded bottom support layer prior to the roll-forming of these layers in the central screen portion to form the raised plateau area therein.
Figure 4B:
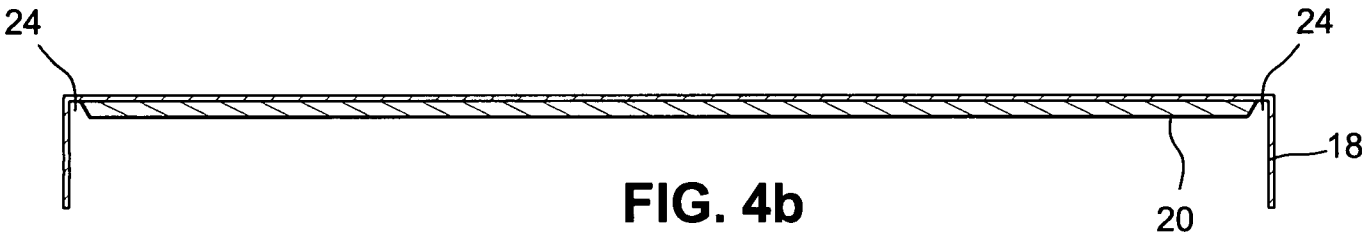
Figure 4C:
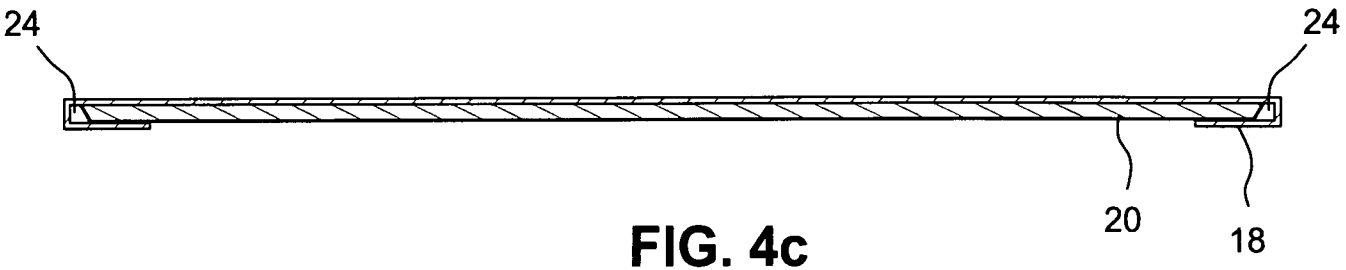

FIGS. 4*a*, 4*b* and 4*c* illustrate steps in a new and improved method for mounting the mesh top layer 18 on the bottom support layer 20 of the central screen portion 12 before they are roll-formed to provide the raised "plateau" area 22 shown in FIG. 1. The mesh top layer 18 is longer than the expanded bottom support layer 20 and is positioned thereon with an overhang at each end as shown in FIG. 4*a*. The overhang may be of any suitable size, such as approximately 9/16 of an inch. Thereafter, the overhanging ends of the mesh top layer 18 are rolled approximately 90 degrees over the ends of the bottom support layer 20 with a space or air gap 24 provided between each end of the support layer 20 and the adjacent portions of the rolled over mesh top layer 18, as shown in FIG. 4*b*. The rolled over ends of the mesh top layer 18 are then rolled under the bottom support layer 20 in generally parallel relation thereto, as shown in FIG. 4*c* with the space or air gap 24 between each end of the bottom support layer 20 and the adjacent rolled over portions of the mesh top layer 18.

The provision of the spaces or air gaps 24 between the ends of the bottom support layer 20 and rolled over portions of the mesh top layer 18 enable the top mesh layer 18 to be stretched over the bottom support layer 20 when they are roll-formed to form the raised "plateau" area 22 shown in FIG. 1 and prevent damage to the rolled over ends of the mesh top layer 18 when it is stretched. By roll forming after the hem process with the desired air gaps 24, it is possible to control lateral tension to the point of not compromising the yield strength of the mesh layer 18 and providing constant contact of the mesh layer 18 to the support layer 20.

Referring again to FIGS. 1-3, the front mounting portion 14 of the gutter guard 10 comprises a first metal sheet 26 having a first portion 28 that is folded over and crimped to the adjacent front end of the central screen portion 12, and a second portion in the form of a depending lip 30 that may be curved toward the front of the gutter guard 10. The metal sheet 26 may be formed of aluminum and is embossed in any suitable pattern or manner, as shown in FIGS. 2 and 3, for the purpose of slowing the flow of rain water thereover and also helping to shed debris that may accumulate thereon.

As shown in FIG. 3, the underside of the folded portion 28 is provided with a plurality of rows of spaced crimps 32 that are disposed in overlapping relation to obstruct and minimize the flow of any rain water that may travel or "wick" around the lip 30 toward the front of the gutter guard where it is mounted on a gutter G shown in broken lines in FIG. 1.

The rear mounting portion 16 of the gutter guard 10 comprises a second metal sheet 34 having a folded front end 36 that extends over and is crimped to the adjacent rear end of the central screen portion 12. The second metal sheet 34 further comprises a rearwardly extending, generally flat portion 38 that terminates in an upstanding leg 40 that extends upwardly and rearwardly from the flat portion 38.

The second metal sheet 34 is formed of a suitable metal such as aluminum and is provided with an embossed outer surface in any suitable manner or pattern for the purpose of slowing the flow of rain water thereover and also helping to shed debris that may accumulate thereon.

The upstanding and angled leg 40 is constructed to engage the adjacent rear portion of the gutter G or fascia 42 and to be deformed inwardly by such engagement, as shown in broken lines in FIG. 1, for the purpose of providing a tight and secure fit of the gutter guard 10 to the rear portion of the gutter G and adjacent fascia 42. The leg 40 is secured to the rear portion of the gutter G and adjacent fascia 42 by any suitable means, such as screws, (not shown) such that there is a slight slope of about 5-6 degrees, for example, downwardly from the rear to the front of the gutter guard 10.

From the foregoing description, it will be readily seen that the gutter guard 10 of the present invention is simple in construction, can be easily mounted on an existing gutter, and effectively slows and dissipates the flow of rain water from the rear to the front portions thereof such that it flows into the underlying gutter without significant flow over the front end of the gutter guard and adjacent front gutter portion.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A gutter guard constructed to be mounted on a gutter and to extend from a front portion to a rear portion of the gutter, the guard comprising:

a central screen portion;

a front mounting portion; and a rear mounting portion;

the screen portion comprising a fine mesh top layer and a bottom support layer of expanded construction with openings of a size to enable rain water to flow at a desired rate through the mesh top layer and the bottom support layer into an underlying gutter;

the mesh top layer and the bottom support layer being roll-formed to provide a raised plateau area in a midportion of the screen portion to slow the flow of rain water from a rear area to a front area of the screen portion and to facilitate the flow of the rain water through the screen portion into the underlying gutter;

the front mounting portion comprising a first metal sheet with a first end portion that is folded over and crimped to an adjacent front end of the screen portion and a second opposite end portion depending from the first end portion and extending toward the front of the gutter guard;

the rear mounting portion comprising a second metal sheet having a folded front end that extends over and is crimped to an adjacent rear end of the screen portion, and a generally flat portion that extends rearwardly and terminates in an upstanding leg that is constructed to engage and be secured to an adjacent fascia board when the gutter guard is mounted on a gutter;

wherein an underside of the first end portion of the first metal sheet of the front mounting portion is provided with a plurality of rows of spaced crimps in overlapping relation to obstruct and minimize the flow of any rain water over the underside toward the second end portion extending toward the front of the gutter guard.

2. The gutter guard of claim 1 wherein the mesh top layer is longer than the bottom support layer so that overhanging ends of the mesh top layer are rolled over adjacent ends of the bottom support layer with end spaces therebetween to enable the mesh top layer to be stretched over the bottom support layer when they are roll-formed to form the raised plateau area, to prevent damage to the rolled overhanging ends of the mesh top layer, to control the lateral tension of the mesh top layer and to provide close contact of the mesh top layer to the bottom support layer.

3. The gutter guard of claim 1 wherein the folded and crimped first end portion of the front mounting portion is constructed to be secured to a front of an underlying gutter by screws.

4. The gutter guard of claim 3 wherein the upstanding leg of the rear mounting portion is constructed to be secured to an adjacent fascia board by screws.

5. The gutter guard of claim 1 wherein the mesh top layer is formed of stainless steel and the bottom support layer is formed of expanded aluminum.

6. The gutter guard of claim 5 wherein the mesh top layer has a predetermined mesh screen size, and the bottom support layer has openings of about 0.5 inches in maximum length and about 0.25 inches in maximum width.

7. The gutter guard of claim 1 wherein the front mounting portion and the rear mounting portion are formed of aluminum.

8. The gutter guard of claim 1 wherein the upstanding leg of the rear mounting portion extends upwardly and rearwardly at an angle to the flat portion so as to tightly engage the adjacent fascia board when the gutter guard is mounted on a gutter to enhance the strength of the mounting.

9. A gutter guard constructed to be mounted on a gutter and to extend from a front portion to a rear portion of the gutter, the guard comprising:

a central screen portion;

a front mounting portion; and a rear mounting portion;

the screen portion comprising a fine mesh top layer and a bottom support layer of expanded construction with openings of a size to enable rain water to flow at a desired rate through the mesh top layer and the bottom support layer into an underlying gutter;

the mesh top layer and the bottom support layer being roll-formed to provide a raised plateau area in a midportion of the screen portion to slow the flow of rain water from a rear area to a front area of the screen portion and to facilitate the flow of the rain water through the screen portion into the underlying gutter;

the front mounting portion comprising a first metal sheet with a first end portion that is folded over and crimped to an adjacent front end of the screen portion and a second opposite end portion depending from the first end portion and extending toward the front of the gutter guard;

the rear mounting portion comprising a second metal sheet having a folded front end that extends over and is crimped to an adjacent rear end of the screen portion, and a generally flat portion that extends rearwardly and terminates in an upstanding leg that is constructed to engage and be secured to an adjacent fascia board when the gutter guard is mounted on a gutter;

wherein the mesh top layer is longer than the bottom support layer so that overhanging ends of the mesh top layer are rolled over adjacent ends of the bottom support layer with end spaces therebetween to enable the mesh top layer to be stretched over the bottom support layer when they are roll-formed to form the raised plateau area, to prevent damage to the rolled overhanging ends of the mesh top layer, to control the lateral tension of the mesh top layer and to provide close contact of the mesh top layer to the bottom support layer.

* * * * *